US008820528B2

(12) United States Patent
Kuo et al.

(10) Patent No.: US 8,820,528 B2
(45) Date of Patent: Sep. 2, 2014

(54) PACKAGING DEVICE FOR MODULE

(71) Applicant: Shenzhen China Star Optoelectronics Technology Co., Ltd., Guangdong (CN)

(72) Inventors: Yicheng Kuo, Shenzhen (CN); Shihhsiang Chen, Shenzhen (CN); Gang Yu, Shenzhen (CN); Jiahe Cheng, Shenzhen (CN); Zhilin Zhao, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/702,130

(22) PCT Filed: Sep. 28, 2012

(86) PCT No.: PCT/CN2012/082240

§ 371 (c)(1), (2), (4) Date: Feb. 7, 2013

(87) PCT Pub. No.: WO2014/040319

PCT Pub. Date: Mar. 20, 2014

(65) Prior Publication Data

US 2014/0076770 A1 Mar. 20, 2014

(30) Foreign Application Priority Data

Sep. 14, 2012 (CN) ..... 2012 1 0341637

(51) Int. Cl.
*B65D 81/05* (2006.01)
*B65D 81/02* (2006.01)

(52) U.S. Cl.
CPC ..... *B65D 81/022* (2013.01); *B65D 81/02* (2013.01)
USPC ..... 206/522

(58) Field of Classification Search
USPC ..... 206/522, 523, 521, 582
See application file for complete search history.

(56) References Cited

U.S. PATENT DOCUMENTS

| | | | | |
|---|---|---|---|---|
| 5,386,911 A * | 2/1995 | Payne | 206/583 |
| 5,570,788 A | 11/1996 | Batsford | |
| 5,622,262 A | 4/1997 | Sadow | |
| 6,415,920 B1 * | 7/2002 | Tiramani et al. | 206/320 |

(Continued)

FOREIGN PATENT DOCUMENTS

| | | |
|---|---|---|
| CN | 1517277 A | 8/2004 |
| CN | 201095481 Y | 8/2008 |
| JP | 2001-348082 A | 12/2001 |

*Primary Examiner* — Steven A. Reynolds
*Assistant Examiner* — King M Chu
(74) *Attorney, Agent, or Firm* — Andrew C. Cheng

(57) ABSTRACT

The present invention provides a module packaging device, which includes a cushioning device and a plurality of retention boards mounted to the cushioning device. The cushioning device includes a plurality of interconnected cushioning air columns of which every two adjacent ones of the cushioning air columns form a receiving channel. The retention boards are respectively mounted in the receiving channels. Modules are each positioned on each of the cushioning air columns between two of the retention boards. The module packaging device uses a cushioning device that is composed of cushioning air columns and the cushioning device, which is of a U-shaped, is positioned in a package box to provide an effect of cushioning and protection to opposite ends and bottom of the liquid crystal modules or the backlight modules received therein to protect the liquid crystal modules or the backlight modules from damages caused by external forces.

6 Claims, 5 Drawing Sheets

(56) References Cited

U.S. PATENT DOCUMENTS

| | | | | |
|---|---|---|---|---|
| 6,471,062 | B2 * | 10/2002 | Usui et al. | 206/521 |
| 2004/0149618 | A1 * | 8/2004 | Otaki et al. | 206/521 |
| 2007/0034548 | A1 * | 2/2007 | De Nola | 206/586 |
| 2007/0062839 | A1 * | 3/2007 | Patterson | 206/523 |
| 2007/0295633 | A1 * | 12/2007 | Liao et al. | 206/522 |
| 2008/0000796 | A1 * | 1/2008 | Lee | 206/521 |

* cited by examiner

PACKAGING DEVICE FOR MODULE

BACKGROUND OF THE INVENTION

1. Field of the Invention

The present invention relates to the field of packaging, and in particular to a packaging device for module.

2. The Related Arts

In the field of manufacture of liquid crystal display devices, the manufacture of liquid crystal display devices includes a process of assembling, which assembles various components, including a liquid crystal module, a backlight module, a main control circuit, and an enclosure, together. These components are each manufactured in advance and packaged for being later assembled to form a complete liquid crystal display device. The liquid crystal module or the backlight module, after being manufactured, are packaged in a package box and then shipped to a corresponding assembling station with the box. Commonly used package boxes include cartons and plastic boxes. Plastic boxes have better structures and low prices, but show poor cushioning performance so that cushioning devices must be additionally provided inside the boxes to effect cushioning. Materials that are commonly used for the cushioning devices are foaming substances, such as expandable polyethylene (EPE) and ethylene-vinyl acetate copolymer (EVA).

As shown in FIG. 1, a package cushioning device 100 for a liquid crystal module or a backlight module is illustrated, comprising a cushioning bottom board 102, two cushioning side boards 104 that are mounted on the cushioning bottom board 102 and arranged at two ends of the cushioning bottom board 102, and three positioning cushioning boards 106 that are mounted on the cushioning bottom board 102 and arranged, in a spaced manner, between the two cushioning side boards 104. The two cushioning side boards 104 are both provided with a plurality of spaced receiving slots 105. The three positioning cushioning boards 106 are all provided with a plurality of positioning slots 107 corresponding to the receiving slots 105. To set up, the liquid crystal modules or the backlight modules (not shown) are fit into the receiving slots 105 and the positioning slots 107.

However, this type of packaging device has a complicated structure and the cushioning materials used are of high prices. In addition, during transportation, due to acceleration or abrupt stop of vehicles, the liquid crystal module or the backlight module is acted upon by an external force to compress the package cushioning device, which undergoes elastic deformation to cushion the external force. However, it is hard for the compressed portion of the cushioning material to spring back, leading to deterioration of the cushioning performance and incapable of being repeated use. The value of recycling is low and it is hard to control cost. It is thus quite apparent that it is a challenge to the present inventor and those devoted themselves to the art to provide a simplified packaging device for liquid crystal module or backlight module that realizes positioning and cushioning for the liquid crystal module or the backlight module during the shipping thereof and also overcomes high cost, complicated structure, and insignificant cushioning performance of the conventional packaging devices for liquid crystal modules or backlight modules.

SUMMARY OF THE INVENTION

An object of the present invention is to provide a packaging device for module, which uses an air pocket and retention board based packaging manner to realize packaging of liquid crystal module or backlight module with a simple structure, low cost, and improved positioning and cushioning effect.

To achieve the object, the present invention provides a module packaging device, which comprises a cushioning device and a plurality of retention boards mounted to the cushioning device. The cushioning device comprises a plurality of interconnected cushioning air columns of which every two adjacent ones of the cushioning air columns form a receiving channel. The retention boards are respectively mounted in the receiving channels. Modules are each positioned on each of the cushioning air columns between two of the retention boards.

The cushioning device comprises first and second cushioning sections that are opposite to each other and a third cushioning section between the first and second cushioning sections. The first, second, and third cushioning sections collectively define a U-shaped configuration. The modules are mounted in the U-shaped configuration.

The receiving channels each comprise a first slot formed in the first cushioning section, a second slot formed in the second cushioning section, and a third slot formed in the third cushioning section.

The retention boards each have two ends respectively fixed in the first and second slots by adhering means.

The two ends of the retention board are bonded in the first and second slots by double-sided adhesive tapes.

The first and second slots form openings. The retention boards each have two ends forming lugs corresponding to the openings. The lugs are fit into and retained in the corresponding openings so as to fix the retention board to the cushioning device.

The retention boards are each of a split arrangement, which comprises a first retention section and a second retention section. The first retention section and the second retention section are respectively mounted in the first and second slots.

The retention boards each further comprise a third retention section. The third retention section is arranged between the first and second retention section and mounted in the third slot.

The first, second, and third retention sections have widths of which a sum is smaller than a spacing distance between the first and second slots.

The modules are liquid crystal modules or backlight modules.

The present invention also provides a module packaging device, which comprises a cushioning device and a plurality of retention boards mounted to the cushioning device, the cushioning device comprising a plurality of interconnected cushioning air columns of which every two adjacent ones of the cushioning air columns form a receiving channel, the retention boards being respectively mounted in the receiving channels, modules being each positioned on each of the cushioning air columns between two of the retention boards;

wherein the cushioning device comprises first and second cushioning sections that are opposite to each other and a third cushioning section between the first and second cushioning sections, the first, second, and third cushioning sections collectively defining a U-shaped configuration, the modules being mounted in the U-shaped configuration;

wherein the receiving channels each comprise a first slot formed in the first cushioning section, a second slot formed in the second cushioning section, and a third slot formed in the third cushioning section;

wherein the retention boards each have two ends respectively fixed in the first and second slots by adhering means;

wherein the two ends of the retention board are bonded in the first and second slots by double-sided adhesive tapes; and wherein the modules are liquid crystal modules or backlight modules.

The efficacy of the present invention is that the present invention provides a module packaging device, which uses a cushioning device that is composed of cushioning air columns to serves as a cushioning device for liquid crystal modules or backlight modules. The cushioning device, which is of a U-shaped, is positioned in a package box to provide an effect of cushioning and protection to opposite ends and bottom of the liquid crystal modules or the backlight modules to thereby effectively protect the liquid crystal modules or the backlight modules from damages caused by external forces. Further, the cushioning device is made of a material that is of low cost, has a simple structure, and can be repeated use without affecting the cushioning performance thereof, so that the cost can be effectively lowered down.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
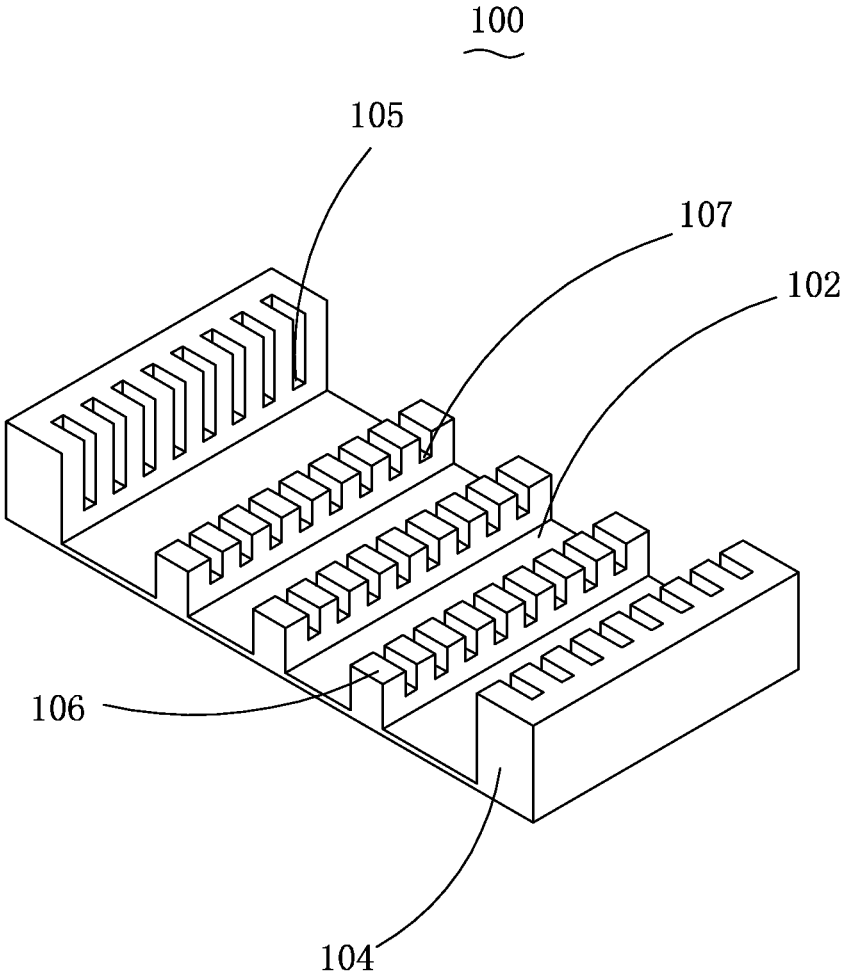
FIG. 1 is a schematic view showing the structure of a conventional package cushioning device for module.
Figure 2:
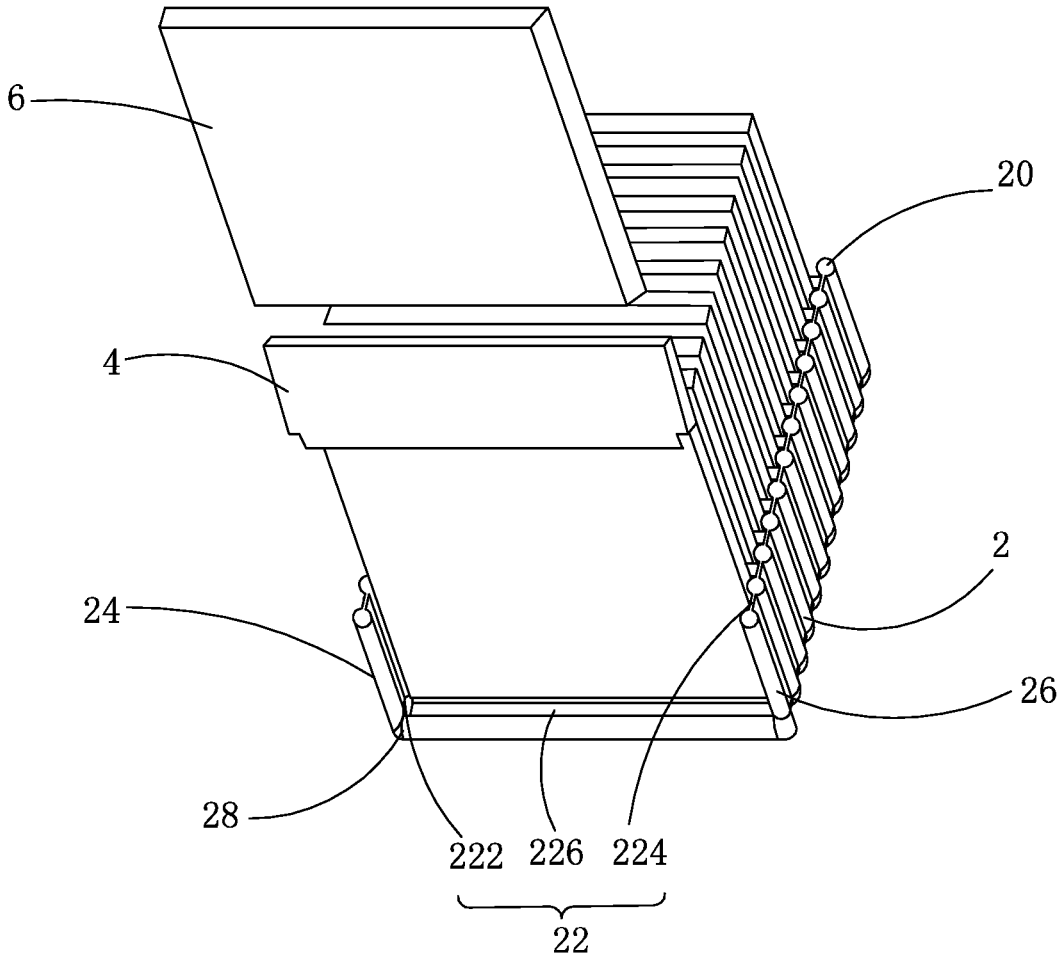
FIG. 2 is a schematic view showing the structure of a module packaging device according to a first embodiment of the present invention.

Referring to FIG. 2, a schematic view is given to show the structure of a module packaging device according to a first embodiment of the present invention, which comprises a cushioning device 2 and a plurality of retention boards 4 mounted to the cushioning device 2. The cushioning device 2 comprises a plurality of interconnected cushioning air columns 20 with a receiving channel 22 formed between every two adjacent cushioning air columns 20. The retention boards 4 are mounted in the receiving channels 22. Each of modules 6 is positioned on each cushioning air column 20 between two retention boards 4. These modules 6 can be liquid crystal modules or backlight modules. The cushioning air column 20 between two adjacent retention boards 4 helps cushioning and protecting the module 6 to prevent the module 6 from damage caused by external forces occurring during various processes including shipping and warehousing.

The cushioning device 2 comprises first and second cushioning sections 24, 26 that are opposite to each other and a third cushioning section 28 between the first and second cushioning sections 24, 26. The first, second, and third cushioning sections 24, 26, 28 collectively define a U-shaped configuration. The modules 6 are positioned in the U-shaped configuration. The cushioning device 2 provides excellent cushioning effect to opposite ends and bottom of the module 6.

The receiving channel 22 comprises a first slot 222 formed in the first cushioning section 24, a second slot 224 formed in the second cushioning section 26, and a third slot 226 formed in the third cushioning section 28. The retention board 4 is received in the first and second slots 222, 224 and the module 6 is born on the third cushioning section 28 between two adjacent retention boards 4.

The retention board 4 has two ends that are fixed in the first and second slots 222, 224 by adhering means. Preferably, the retention board 4 is bonded in the first and second slots 222, 224 by pieces of double-sided adhesive tape. Using double-sided adhesive tapes to tightly bond the two ends of the retention board 4 and the first and second slots 222, 224 provides excellent fixing of the retention board 4. In addition, the double-sized adhesive tape is advantageous of being easily trimmed to any desired shape and being easy to remove with residual adhesive being easily cleaned off after the removal of the tape. Further, the double-sized adhesive tape is low in cost and has the efficacy of environmental conservation.

Figure 3:
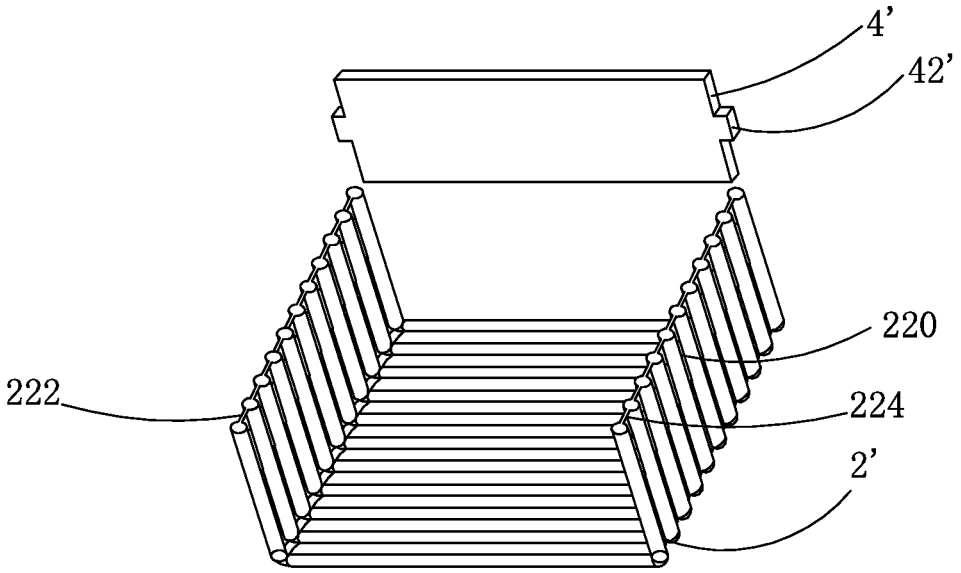
FIG. 3 is a schematic view showing the structure of a module packaging device according to a second embodiment of the present invention.

Referring to FIG. 3, a schematic view is given to show the structure of a module packaging device according to a second embodiment of the present invention, in the instant embodiment, the first and second slots 222, 224 are respectively provided with openings 220 and the retention boards 4' each form lugs 42' at opposite ends thereof to correspond to the openings 220. The lug 42' are fit into and retained in the openings 220 thereby mounting the retention board 4' to the cushioning device 2'. In the instant embodiment, using the two lugs 42' and the two openings 220 to engage each other achieves fixing and connecting between the retention board 4' and the cushioning device 2' with a simple structure that is easy to remove and thus effectively lowers the cost.

Figure 4:
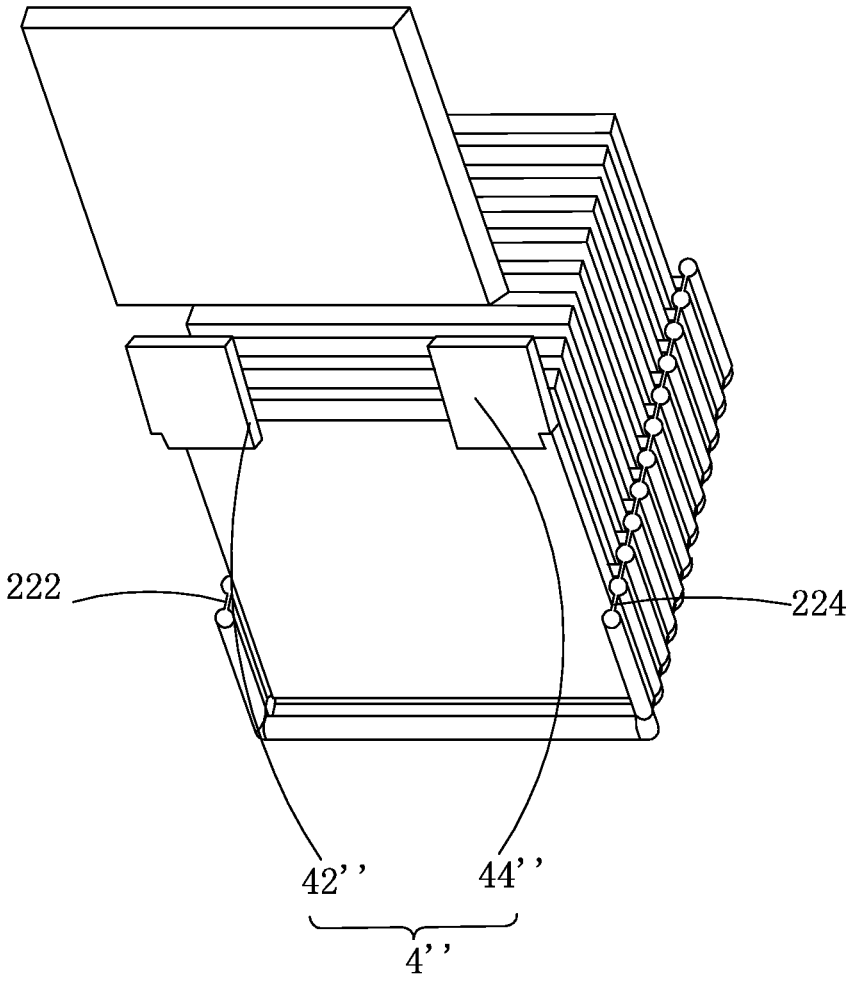
FIG. 4 is a schematic view showing the structure of a module packaging device according to a third embodiment of the present invention.

Referring to FIG. 4, a schematic view is given to show the structure of a module packaging device according to a third embodiment of the present invention, in the instant embodiment, the retention boards 4" has a split arrangement, which comprises a first retention section 42" and a second retention section 44". The first retention section 42" and the second retention section 44" are respectively mounted in the first and second slots 222, 224. Ends of the first retention section 42" and the second retention section 44" are respectively bonded in the first and second slots 222, 224 with double-sided adhesive tapes so as to well fix the retention boards 4". Further, the double-sized adhesive tape is advantageous of being easily trimmed to any desired shape and being easy to remove with residual adhesive being easily cleaned off after the removal of the tape. In addition, the double-sized adhesive tape is low in cost and has the efficacy of environmental conservation. The split arrangement of the retention board 4", besides saving material, reduces the weight and further reduces the cost.

Figure 5:
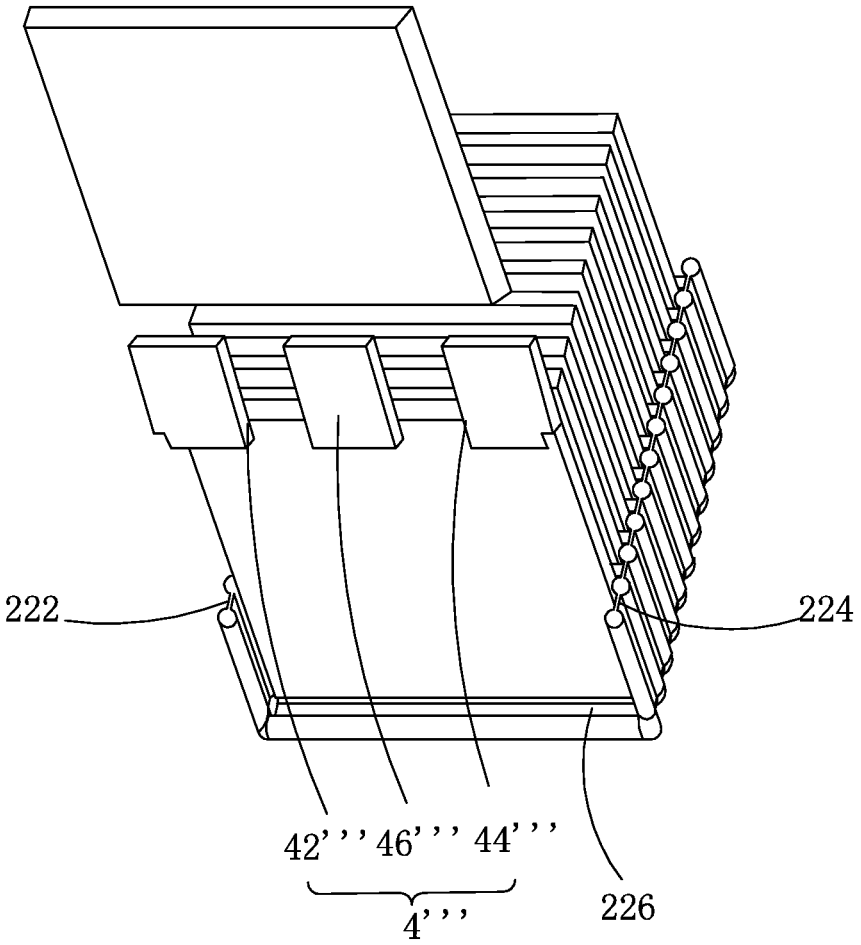
FIG. 5 is a schematic view showing the structure of a module packaging device according to a fourth embodiment of the present invention.

Referring to FIG. 5, a schematic view is given to show the structure of a module packaging device according to a fourth embodiment of the present invention, in the instant embodiment, the retention boards 4''' has a split arrangement, which comprises a first retention section 42''', a second retention section 44''', and a third retention section 46'''. The sum of widths of the first, second, and third retention sections 42''', 44''', 46''' is smaller than spacing distance between the first and second slots 222, 224 in order to allow the first, second, and third retention sections 42''', 44''', 46''' to be all received between the first and second slots 222, 224.

The first retention section 42''' and the second retention section 44''' are respectively mounted in the first and second slots 222, 224. The third retention section 46''' is arranged between the first and second retention section 42''', 44''' and received in the third slot 226. Ends of the first retention section 42''' and the second retention section 44''' are respectively bonded, at opposite sides thereof, in the first and second slots 222, 224 with double-sided adhesive tape so as to well fix the retention board 4''' to achieve saving of material and also reducing weight and cost.

In summary, the present invention provides a module packaging device, which uses a cushioning device that is composed of cushioning air columns to serves as a cushioning device for liquid crystal modules or backlight modules. The cushioning device, which is of a U-shaped, is positioned in a package box to provide an effect of cushioning and protection to opposite ends and bottom of the liquid crystal modules or the backlight modules to thereby effectively protect the liquid crystal modules or the backlight modules from damages caused by external forces. Further, the cushioning device is made of a material that is of low cost, has a simple structure, and can be repeated use without affecting the cushioning performance thereof, so that the cost can be effectively lowered down.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A module packaging device, comprising a cushioning device and a plurality of retention boards mounted to the cushioning device, the cushioning device comprising a plurality of interconnected cushioning air columns of which every two adjacent ones of the cushioning air columns form a receiving channel, the retention boards being respectively mounted in the receiving channels, modules being each positioned on each of the cushioning air columns between two of the retention boards;

wherein the cushioning device comprises first and second cushioning sections that are opposite to each other and a third cushioning section between the first and second cushioning sections, the first, second, and third cushioning sections collectively defining a U-shaped configuration, the modules being mounted in the U-shaped configuration;

wherein the receiving channels each comprises a first slot formed in the first cushioning section, a second slot formed in the second cushioning section, and a third slot formed in the third cushioning section;

wherein the retention boards are each of a split arrangement, which comprises a first retention section and a second retention section, the first retention section and the second retention section being respectively mounted in the first and second slots;

wherein the retention boards each further comprises a third retention section, the third retention section being arranged between the first and second retention sections and mounted in the third slot; and wherein the first, second, and third retention sections have widths of which a sum is smaller than a spacing distance between the first and second slots.

2. The module packaging device as claimed in claim 1, wherein the retention boards each have two ends respectively fixed in the first and second slots by adhering means.

3. The module packaging device as claimed in claim 2, wherein the two ends of the retention board are bonded in the first and second slots by double-sided adhesive tapes.

4. The module packaging device as claimed in claim 1, wherein the first and second slots form openings, the retention boards each having two ends forming lugs corresponding to the openings, the lugs being fit into and retained in the corresponding openings so as to fix the retention board to the cushioning device.

5. The module packaging device as claimed in claim 1, wherein the modules are liquid crystal modules or backlight modules.

6. A module packaging device, comprising a cushioning device and a plurality of retention boards mounted to the cushioning device, the cushioning device comprising a plurality of interconnected cushioning air columns of which every two adjacent ones of the cushioning air columns form a receiving channel, the retention boards being respectively mounted in the receiving channels, modules being each positioned on each of the cushioning air columns between two of the retention boards;

wherein the cushioning device comprises first and second cushioning sections that are opposite to each other and a third cushioning section between the first and second cushioning sections, the first, second, and third cushioning sections collectively defining a U-shaped configuration, the modules being mounted in the U-shaped configuration;

wherein the receiving channels each comprise a first slot formed in the first cushioning section, a second slot formed in the second cushioning section, and a third slot formed in the third cushioning section;

wherein the retention boards are each of a split arrangement configured with a first retention section and a second retention section which are respectively mounted in the first and second slots with two ends respectively fixed in the first and second slots by double-sided adhesive tapes;

wherein the retention boards each further comprises a third retention section, the third retention section being arranged between the first and second retention sections and mounted in the third slot;

wherein the first, second, and third retention sections have widths of which a sum is smaller than a spacing distance between the first and second slots; and wherein the modules are liquid crystal modules or backlight modules.

* * * * *